United States Patent [19]

Thrash

[11] 4,322,706

[45] Mar. 30, 1982

[54] PISTON ACTUATED STRIKER FOR ELECTRIC FUSE

[75] Inventor: Robert N. Thrash, Tucker, Ga.

[73] Assignee: Kearney-National, Inc., Atlanta, Ga.

[21] Appl. No.: 216,288

[22] Filed: Dec. 15, 1980

[51] Int. Cl.[3] ..... H01H 37/02; H01H 85/30

[52] U.S. Cl. ..... 337/417; 337/244

[58] Field of Search ..... 337/417, 244, 241, 248, 337/401, 30; 116/105, 217

[56] References Cited

U.S. PATENT DOCUMENTS 2,639,350 5/1953 Cox ..... 337/244

*Primary Examiner*—Harold Broome

*Attorney, Agent, or Firm*—Rodgers & Rodgers

[57] ABSTRACT

A fuse striker affords a visual or other indication of an operated condition of an associated fuse and is mounted within the fuse and comprises a housing structure coaxially arranged within the fuse with an end of the housing in contact with an end of the fuse, closure structure for the opposite end of the striker housing and comprising mating half sections with a longitudinal groove formed in at least one complementary surface through which an elongated high resistance ignition element extends and which is in shunt with the fusible elements of the fuse so as to contact with pyrotechnic material interposed between the closure means and a cup like piston element having an outwardly flared lip portion whereby ignition of the pyrotechnic element drives the piston toward the opposite end of the housing so as to thrust a striker pin mounted therein through the fuse cap so as to afford a visual indication of the operated condition of the fuse, the pyrotechnic material being ignited upon rupture of the fusible elements by the resulting flow of current through the shunt connected ignition element.

18 Claims, 5 Drawing Figures

PISTON ACTUATED STRIKER FOR ELECTRIC FUSE

TECHNICAL FIELD

This invention relates to striker devices mounted inside totally enclosed fuse structure and arranged to pierce one end of the fuse structure upon operation of the fuse thereby to provide a visual indication of the operated condition of the fuse or so as to actuate an auxiliary device such as a switching device.

BACKGROUND ART

One known type of fuse striker is of the spring actuated type wherein a striker pin is seated on a compressed spring that is held in compressed condition by a high resistance strain wire which upon interruption of the fuse is quickly melted due to the fact that shunt current through the high resistance strain wire causes melting and a resulting release of the pin which protrudes through the end of the fuse to provide an indication of the operated condition of the fuse or to actuate a signal or switching device.

Objections to the spring actuated type of striker assembly are due to the high cost and large physical dimensions thereof.

Another known fuse striker is of the so-called pyrotechnic or powder-actuated type wherein a powder charge is ignited by an ignition element to actuate piston means and thus to drive the striker pin into its operated condition.

The disadvantages of the powder actuated device center primarily around the fact that such mechanisms must be constructed of low tolerances so as to prevent the escape of piston actuating gases. Such constructions are particularly costly and are vulnerable to rough handling since the ignition element is usually of a high resistance fragile wire which is easily damaged because of its brittle nature.

DISCLOSURE OF THE INVENTION

According to this invention in one form, a low cost closure element for one end of a striker housing is provided and comprises two or more complementary mating sections with a longitudinal groove formed in the face of at least one mating section for receiving a fragile elongated ignition element and for effectively closing one end of the housing so as to render such end substantially gas tight so that piston means within the housing and which is operated by pyrotechnic material is arranged in a cup-like configuration with an outwardly flared lip portion whereby leakage of propulsion gases between the piston and housing wall is substantially eliminated without requiring close machining tolerances for the flared piston and for the inner surface of the housing.

BEST MODE OF CARRYING OUT THE INVENTION

Figure 1:
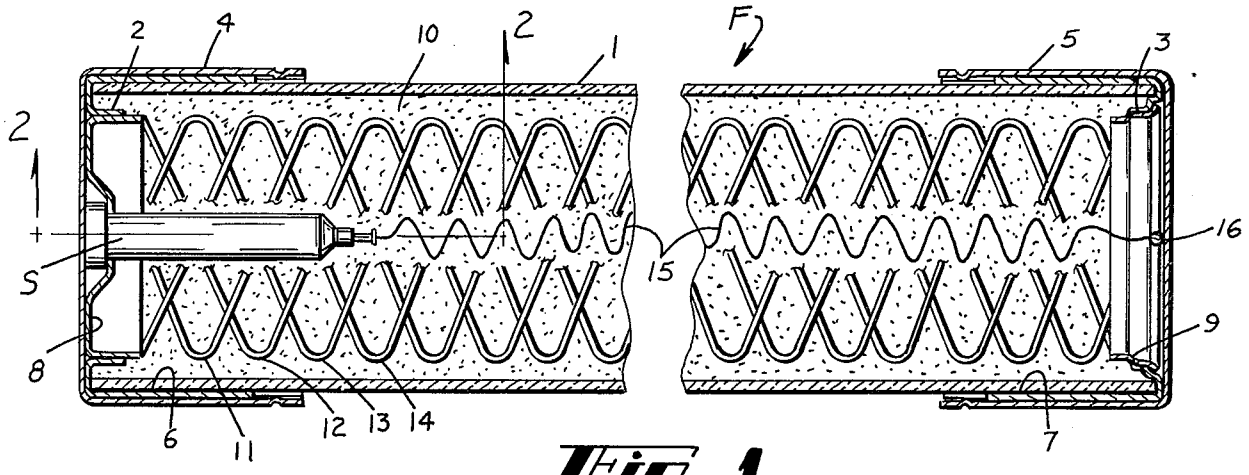
FIG. 1 is a cross-sectional view of an electric fuse having a fuse striker formed according to one form of this invention.
Figure 2:
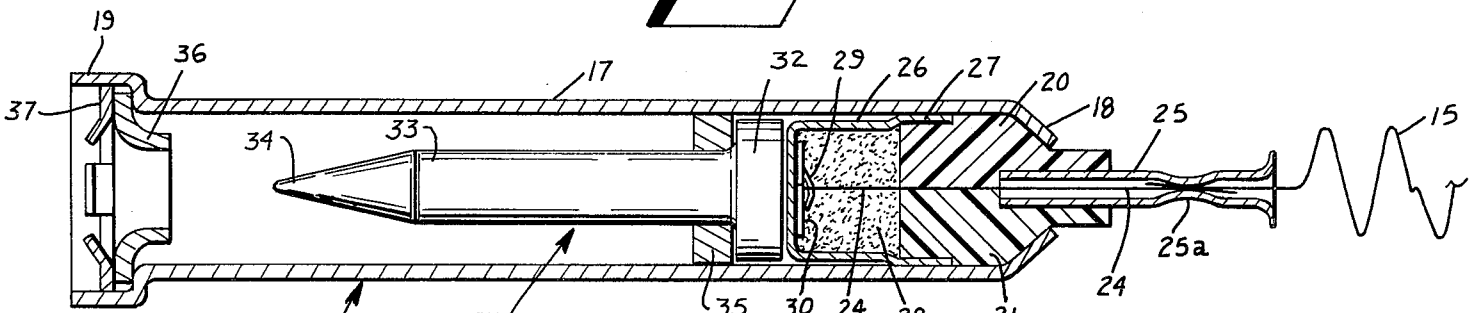
FIG. 2 is an enlarged cross-sectional view of the fuse striker assembly shown generally in FIG. 1 and with the striker in its normal unoperated condition.
Figure 3:
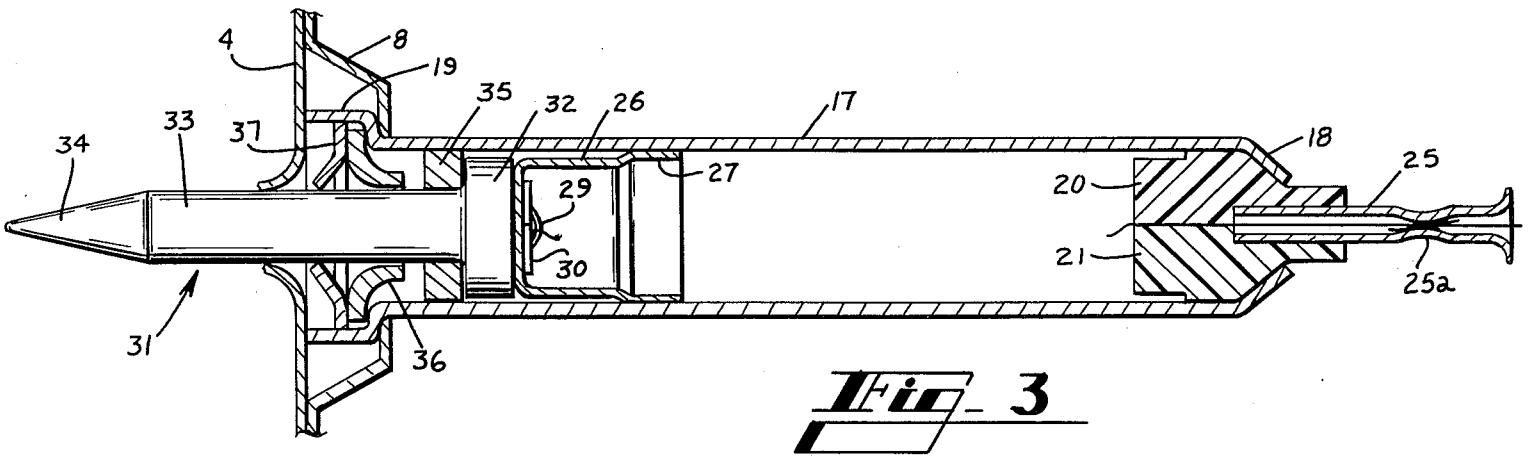
FIG. 3 is a cross-sectional view of a fuse striker assembly similar to FIG. 2 but which shows the mechanism in its operated condition.
Figure 5:
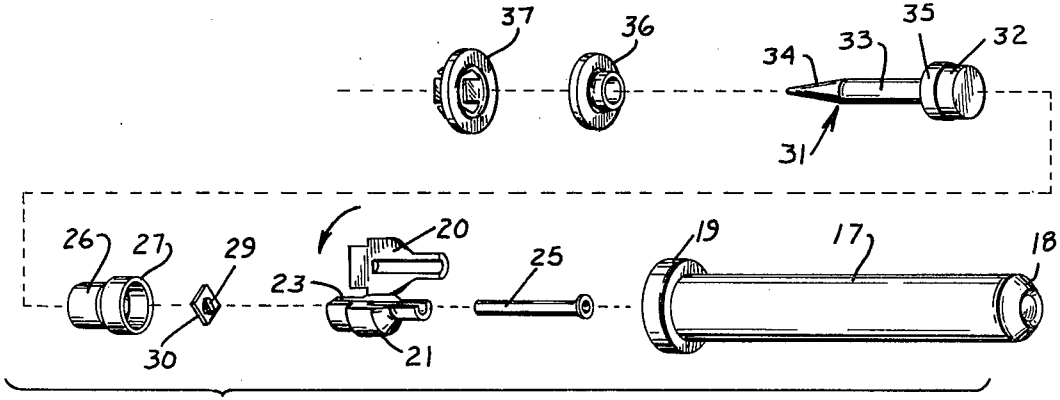
FIG. 5 is an exploded view of the component parts shown in assembled condition in FIGS. 2 and 3.

In the drawings the numeral 1 designates a tubular housing for fuse F and which is formed of insulating material. End caps 2 and 3 are disposed at opposite ends of the tubular housing 1 and are formed of suitable conducting material. Outer caps 4 and 5 are secured about the end caps 2 and 3 respectively by a pressed fit and the end caps 2 and 3 are secured to the tubular housing 1 by means of cement 6 and 7. End terminal rings 8 and 9 are secured to the inner surfaces of inner caps 2 and 3 and are disposed within central apertures formed within end caps 2 and 3. The housing structure is filled with silica sand 10 which preferably is in the form of approximately spherically shaped grains of random size within a given range.

Disposed within the housing of the fuse F and embedded within and supported by the granular filler 10 are a plurality of helical fusible elements 11-14. As is apparent from FIG. 1, these helical elements 11-14 are arranged with their ends connected with the terminal rings 8 and 9 respectively. Rings 8 and 9 together with caps 4 and 5 constitute terminal elements for the fuse F.

In accordance with this invention in one form striker S is mounted within the fuse F in abutting contact with cap 4 at its left hand end and is connected at its right hand end with a high resistance coiled wire 15 the right hand end of which is electrically connected at 16 with cap 5. Since the wire 15 is of high resistance and because the fusible elements 11-14 are of low resistance, the current through the fuse is conducted under normal conditions by the fusible elements 11-14. When these elements are melted, the line voltage is applied across the high resistance wire 15 and consequently creates a current through the ignition element 24 and through the conducting parts of striker assembly S to operate that assembly.

As is best shown in FIGS. 2-5 inclusive, striker S includes a tubular housing 17 which is crimped inwardly at its right hand end as indicated at 18 and which is outwardly flanged at its left hand end as indicated at 19.

Figure 4:
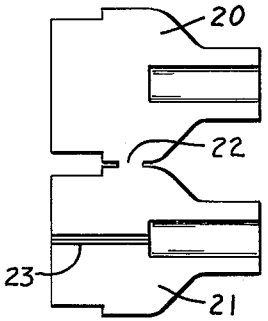
FIG. 4 is an enlarged view of the closure structure for one end of the fuse formed in accordance with one feature of the invention.

In accordance with a feature of this invention closure structure for the right hand end of the tubular housing 17 comprises mating sections 20 and 21 which are hingedly connected at their peripheries by the hinge structure 22 as best shown in FIG. 4. A longitudinal groove 23 is formed in mating half section 21 and receives the ignition element 24 so that when half section 20 is swung over into flat face contacting relation with half section 21, the ignition element 24 is securely captured within the groove 23. The prior art practice of drilling a small diameter hole through a unitary closure element is thus eliminated. The wire 24 which preferably is formed of tungsten and its associated groove 23 are approximately five thousandths of an inch in transverse dimension. Secure protection for the fragile high resistant tungsten wire is thus provided without the necessity of threading this fragile wire through a small hole. This tungsten ignition wire is interconnected with wire 15 by the expedient of mechanically clamping or crimping the tubular connector 25 as is best shown at 25*a* in FIG. 2. Half sections 20 and 21 may be formed of plastic or elastomeric material.

In order to form an effective seal between the cup-like piston 26 and the inner surface of the tubular housing 17 without the necessity for performing extensive closely controlled machining operations, the cup-like piston 26 is outwardly flared along its lip portion 27 so as to form an effective seal with the inner surface of tubular housing 17. Pyrotechnic material 28 is disposed within the enclosure defined by the mating half sections 20 and 21 on the right hand end and the cup-like piston 26. The left hand end of ignition element 24 is secured to contact 29 which is integrally formed and struck from the contact plate 30 mounted within the cup-like piston 26 and secured to the bottom thereof by any suitable means such as by welding or press fit.

The striker pin generally indicated at 31 comprises an enlarged base portion 32 and a smaller spindle portion 33 having a point 34 at its left hand end.

For the purpose of guiding the sliding movement of striker 31 through the tubular housing 17, a guide collar 35 is disposed about the spindle 33 and is slidable within the tubular housing 17.

The left hand end of the striker assembly S includes a pin stop 36 secured within the outwardly flared portion 19 of tubular housing 17 and a pin lockout spring 37.

An excessive current which causes the fusible elements 11-14 to melt causes a current to flow through the high resistance wire 15 which is sufficient to heat the tungsten ignition wire 24 sufficiently to ignite the pyrotechnic material 28. This action establishes pressure in the enclosure between the mating half sections 20 and 21 on the one hand and the cup-shaped piston 26 on the other which pressure drives the piston toward the left and causes the striker 31 to move from the position represented in FIG. 2 to that represented in FIG. 3 and to pierce the end cap 4. The striker point 34 then is observable and indicates that the fuse has operated. Of course the striker pin 31 may serve by known procedures to actuate some other signal or a switching device if desired.

INDUSTRIAL APPLICABILITY

The invention is well suited for application in electric fuses and makes possible an effective striker mechanism which may be constructed of a number of standard parts without requiring expensive low tolerance special machining procedures and also provides effective means for securing a strain wire to a tungsten ignition wire which is of fragile and brittle construction while affording protection for such fragile structure from damage due to rough handling especially during assembly of the mechanism due in part to the avoidance of threading such wire through a small hole without impairing the gas tight capability of the housing closure formed by complementary mating sections.

What is claimed is:

1. A fuse striker comprising a tubular housing, at least two mating sections arranged in snug contacting complementary relation to each other and forming a closure structure for one end of said housing, piston means disposed in said housing and normally cooperating with said closure structure to form a substantially fluid tight enclosure, a striker pin disposed within said housing and arranged to move toward the other end thereof in coordination with operating movement of said piston, pyrotechnic material disposed within said enclosure, an elongated ignition element embedded in said pyrotechnic material and interposed between contacting surfaces of said mating sections, and means for activating said ignition element.

2. A fuse striker according to claim 1 wherein said piston means comprises an outwardly flanged cup-like structure.

3. A fuse striker according to claim 1 wherein said piston means comprises a cup-like structure having an outwardly flanged lip section.

4. A fuse striker according to claim 1 wherein a longitudinal groove is formed in the contacting surface of at least one of said mating sections for receiving said ignition element.

5. A fuse striker according to claim 4 wherein said ignition element and said longitudinal groove are interrelated so as to form a substantially gas tight structure.

6. A fuse striker according to claim 1 wherein said mating sections are formed of a suitable plastic or elastomeric material.

7. A fuse striker according to claim 1 wherein said ignition element comprises a wire formed of tungsten.

8. A fuse striker according to claim 1 wherein a contact is disposed in current carrying contact with said piston means and is electrically connected with said ignition element.

9. A fuse striker according to claim 1 wherein a tubular connector is embedded in said closure structure and disposed to receive said ignition element.

10. A fuse striker according to claim 9 wherein an end of a conductor of high resistance is disposed in said tubular connector alongside and in electrical contact with said ignition element.

11. A fuse striker according to claim 10 wherein said tubular connector is crimped so as to form a secure connection between said ignition element and said conductor.

12. A fuse striker according to claim 1 wherein a striker pin is disposed in said tubular housing and arranged to be driven toward the other end thereof by said piston means upon actuation of said pyrotechnic material.

13. A fuse striker according to claim 1 wherein said mating sections are of molded insulating material.

14. A fuse striker according to claim 1 wherein said mating sections are adjoined by peripheral hinge means.

15. A fuse striker according to claim 4 wherein said longitudinal groove is of the order of five thousandths of an inch in its transverse dimension.

16. A fuse striker comprising a tubular housing, substantially gas tight closure structure for one end of said housing, a cup-shaped piston disposed in said housing and arranged with its lip section adjacent said closure structure and with its bottom section remote from said closure structure to define an enclosure, said lip section being outwardly flared and in contact with the inner surface of said housing to form a substantially gas tight relation therewith, a striker pin disposed within said tubular structure and arranged for movement toward the other end of said tubular structure in coordination with operating movement of said piston, and means for substantially increasing the pressure within said enclosure thereby to impart operating movement to said piston.

17. A fuse striker according to claim 16 wherein said striker pin is separate from said piston and comprises a base portion of complementary configuration to the interior of said housing and which is slidable therein, and a striker spindle mounted on said base portion and movable therewith toward the other end of said housing in coordination with engagement of said base portion by said piston during operating movement thereof.

18. A fuse striker according to claim 17 wherein a guide collar is disposed about said striker spindle and is slidable therewith in said housing.

* * * * *